US005355965A

United States Patent [19]

Rozendaal

[11] Patent Number: 5,355,965

[45] Date of Patent: Oct. 18, 1994

[54] MOUNTING APPARATUS FOR A ROTATIONAL DRIVE UNIT

[75] Inventor: Peter C. Rozendaal, Pella, Iowa

[73] Assignee: Vermeer Manufacturing Company, Pella, Iowa

[21] Appl. No.: 34,559

[22] Filed: Mar. 19, 1993

[51] Int. Cl.[5] ..... E21C 5/06

[52] U.S. Cl. ..... 173/141; 173/147; 173/148

[58] Field of Search ..... 173/147, 148, 149, 141

[56] References Cited

U.S. PATENT DOCUMENTS 2,338,625 1/1944 Curtis ..... 173/147
2,868,508 1/1959 Cowan ..... 173/147
3,684,035 8/1972 Wills ..... 173/147
3,692,123 9/1972 Gyongyosi ..... 173/147
3,721,305 3/1973 Mayer et al. ..... 173/147

*Primary Examiner*—Scott A. Smith
*Attorney, Agent, or Firm*—Kent A. Herink; Brian J. Laurenzo; Brett J. Trout

[57] ABSTRACT

A mounting apparatus for a rotational drive unit. The rotational drive unit includes a socket portion which receives a truck or carrier. Opposing engagement surfaces of the carrier are separated by a distance greater than the length of the socket. The resulting lost motion connection allows for a range of free movement of the rotational head on the carrier.

5 Claims, 2 Drawing Sheets

MOUNTING APPARATUS FOR A ROTATIONAL DRIVE UNIT

BACKGROUND OF THE INVENTION

The invention relates generally to apparatus for mounting a rotational drive unit and, more particularly, to a lost motion mounting apparatus for interconnecting a rotational drive unit on a support track.

There are a wide variety of designs and uses for rotational drive units. A common use is to rotate threaded couplings or gear systems wherein the rotational movement produces relative motion of the rotational drive unit and the coupling or gear system. The mounting of the rotational drive unit must be capable of accommodating this relative motion. Applications which also include the translational movement of the rotational drive unit require further accommodation from the mounting apparatus.

A particular application of travelling rotational drive units is in underground tunnelling systems for advancing a boring head and associated drill string from an above-ground platform along a desired underground path. In assembling and disassembling the drill string from or into its constituent pipe sections, the rotational drive unit is reciprocally moved along a support track and rotated to thread and unthread the pipe sections. If the mounting apparatus of the rotational drive unit does not permit a range of movement of the rotational drive unit relative to the pipe section engaged by the rotational drive unit, the position of the rotational drive unit must be manually adjusted in small increments to prevent binding of the rotational drive unit, the pipe section, and the support rack.

SUMMARY OF THE INVENTION

The invention consists of a mounting apparatus for a rotational drive unit. The mounting apparatus includes a carrier that is interconnected to the rotational drive unit for a range of lost motion of the rotational head relative to the carrier over a range within a principal dimension of the carrier. In the preferred embodiment, the carrier is mounted on a support track for reciprocal movement along the track. The rotational head is also supported on the track. The carrier has a pair of opposing engagement surfaces and the rotational drive unit has a cooperating abutment member positioned between the opposing engagement surfaces of the carrier. The carrier is free to move relative to the rotational drive unit within the range defined by the separation of the opposing engagement surfaces. Movement of the carrier beyond this range will bring a corresponding one of the engagement surfaces into contact with the abutment member resulting in movement of the rotational drive unit by the carrier.

An object of the invention is to provide a lost motion mounting apparatus for a rotational drive unit which will permit a range of translational movement of the rotational drive unit while rotating a threaded coupling, gear system, or the like.

This and other objects of the invention will be evident to a person of skill in the art to which the invention pertains upon a review of the drawings, description and claims hereof.

DETAILED DESCRIPTION OF A PREFERRED EMBODIMENT

Figure 1:
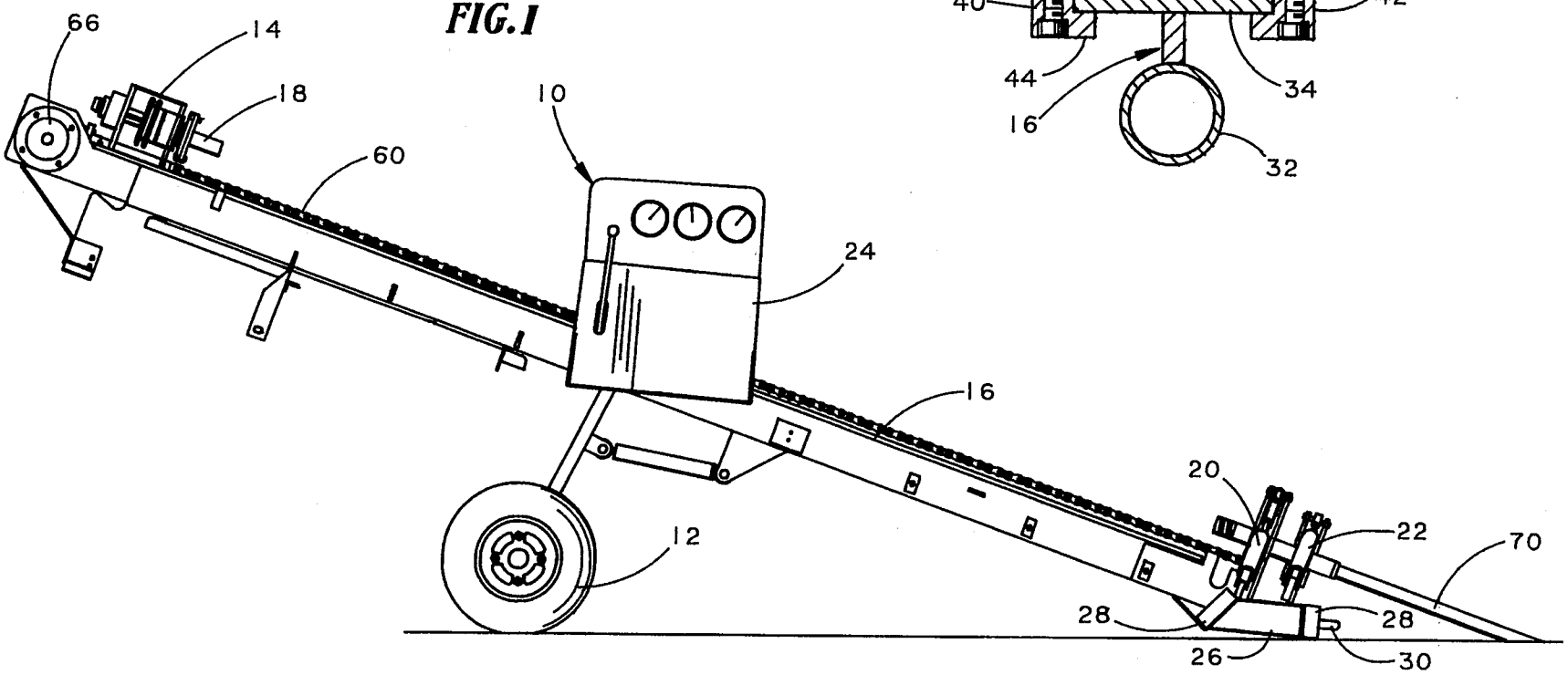
FIG. 1 is a side view of an underground tunnelling apparatus which incorporates the present invention.

Illustrated in FIG. 1, generally at 10, is an underground tunnelling apparatus for use in assembling, rotating, advancing, withdrawing, and disassembling a drill string consisting of a plurality of mating pipe sections arranged head to tail and releasably threaded together. The tunnelling apparatus 10 is ground-supported on a pair of collapsible wheels 12 mounted at the mid section thereof. A powered rotational drive unit or head 14 is mounted for sliding movement between the upper or rearward and lower or forward end portions of the apparatus 10 on a longitudinal track 16. A threaded stem section 18 extends from the rotational head 14 for reversible threaded engagement with a drill string of the tunneling apparatus 10, as will be described below. A pair of clamping vices 20 and 22 are mounted at the lower end portion of the tunnelling apparatus 10. The operation of the apparatus 10, including the clamps 20 and 22 and the direction of rotation and movement of the rotational head 14 is controlled at an operator's station 24.

The base or lower end portion of the tunnelling apparatus 10 includes a platform 26 which, during normal operation of the tunnelling apparatus 10, rests on the ground. The platform 26 and tunnelling apparatus 10 may be firmly anchored to the ground at a desired location by driving one or more spikes (not shown) through any or all of the four sleeves 28 associated one each with the corners of the platform 26. A handle 30 is attached to the platform 26 to assist in raising the lower end portion of the tunnelling apparatus 10 and positioning of the tunnelling apparatus 10. Each of the clamps 20 and 22 are supported on the platform 26 in coaxial alignment. The construction and operation details of the clamps 20 and 22 are described in pending U.S. patent application Ser. No. 08/028,365, filed on Mar. 9, 1993, and entitled "Clamping Vice," which is incorporated herein by this reference.

Figure 6:
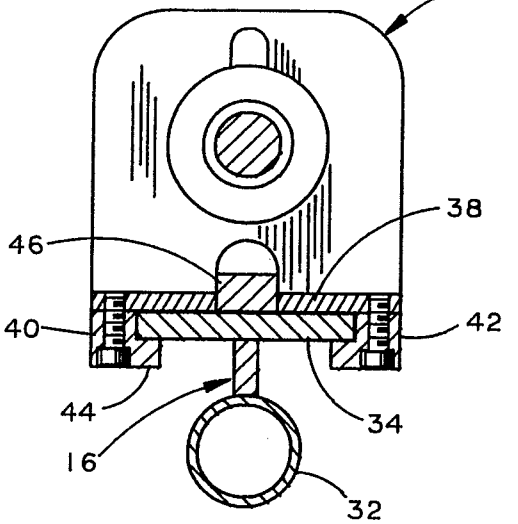
FIG. 6 is a cross-sectional view taken along line 6—6 of FIG. 2.

As best illustrated in FIG. 6, the track 16 of the underground tunnelling apparatus 10 includes a tube 32 that extends longitudinally of the underground tunnelling apparatus 10 and a support rack 34 which is supported above and mounted to the tube 32 by a stand-off 36. The support rack 34 and stand-off 36 are coextensive in length with the tube 32. The rotational head 14 includes a flat base portion 38 that is held in sliding contact atop the support rack 34 by a pair of retaining members 40 and 42 which are bolted to the underside of the rotational head 14. The retaining members 40 and 42 are substantially L-shaped in transverse cross section and include an inwardly extended leg portion 44 that project below the support rack 34 from either side.

Figure 4:
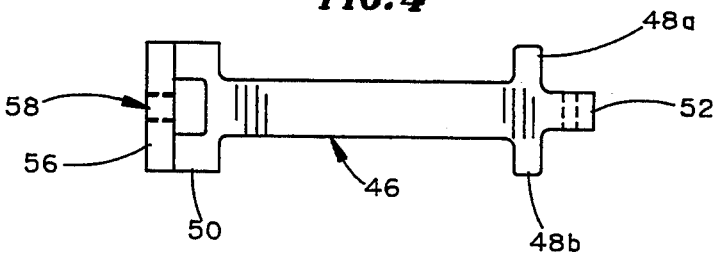
FIG. 4 is a plan view of the carrier of FIG. 3.
Figure 5:
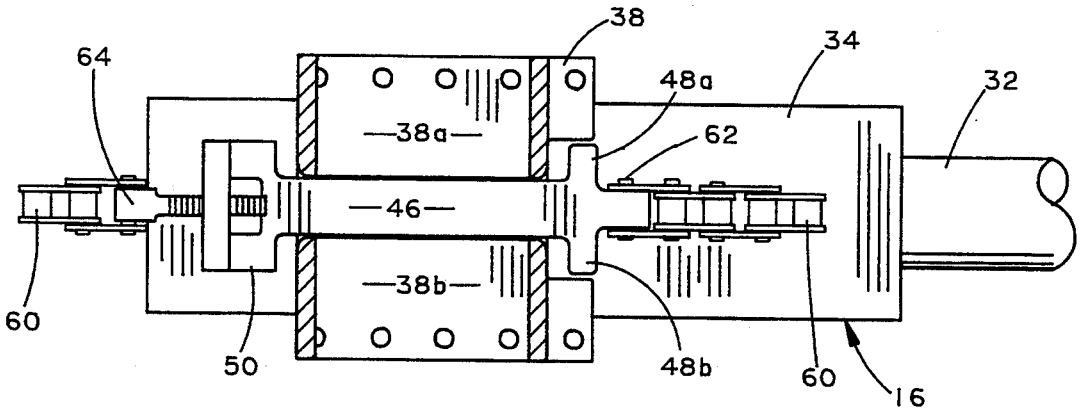
FIG. 5 is a cross-sectional view taken along line 5—5 of FIG. 2.

The base plate 38 is divided into two portions 38*a* and 38*b* (FIG. 5) that are separated by a distance sufficient to accommodate therebetween a truck or carrier 46. The carrier 46 is substantially I-shaped in plan view (FIGS. 4 and 5), including a front portion having a pair of transversely extended arm members 48*a* and 48*b* and a transversely widened rear portion 50. The forward end portion of the carrier 46 also includes a forwardly projected portion 52 having a transverse throughbore 54. The rear end portion 50 includes an upwardly extended attachment member 56 having a longitudinal throughbore 58. The distance between the arm portions 48 and transversely widened rear portion 50 defines a principal dimension of the carrier 46 which is greater than the longitudinal dimension of the base plate 38 of the rotational head 14 (FIG. 5). Accordingly, the carrier 46 is free to slide relative to the rotational unit 14 within the limits defined by, in the forward direction by contact of the engagement surfaces of the transversely widened rear portion 50 with the rear portion of the base plate 38 and, in the rearward direction, by contact of the engagement surfaces of the arm portions 48*a* and 48*b* with the forward end portion of the base plate 38.

Figure 2:
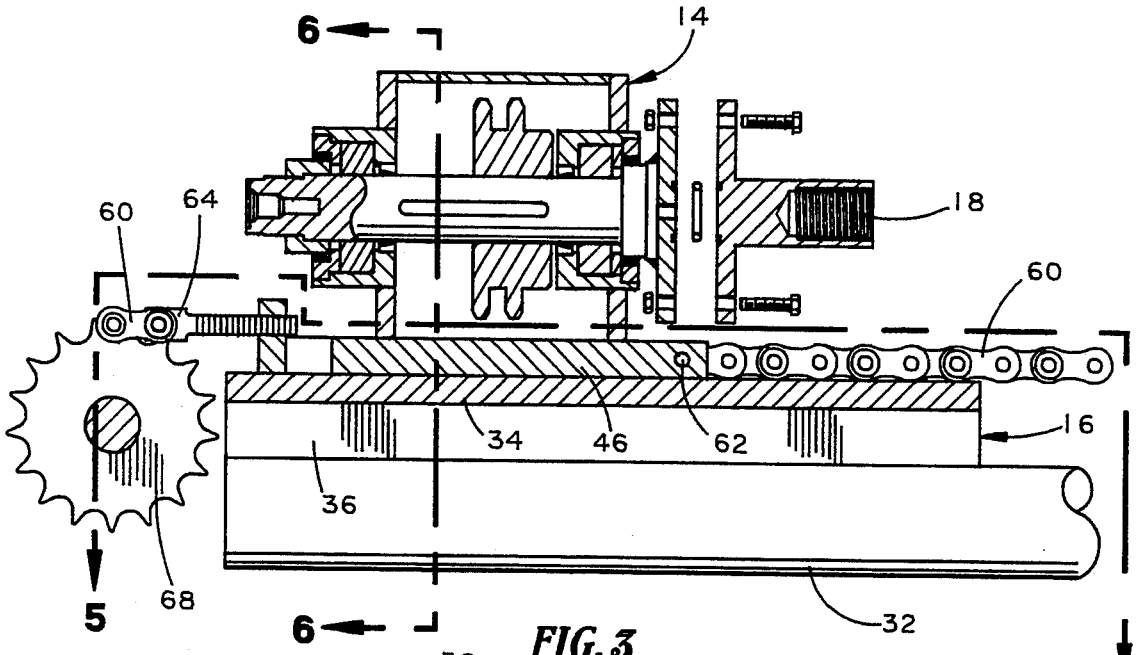
FIG. 2 is a partial cross-sectional view of a rotational drive head of the underground tunnelling apparatus of FIG. 1.
Figure 3:
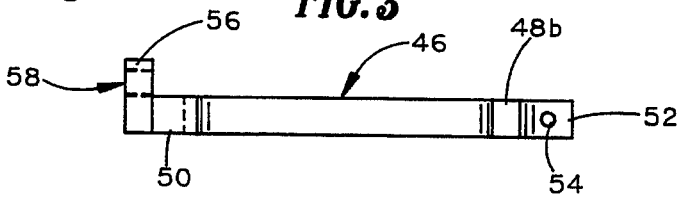
FIG. 3 is a side elevational view of a carrier of the present invention.

The carrier 46 is secured at the forward end portion 52 to a first end of a roller chain 60 by way of a pin 62 inserted in the throughbore 54. The roller chain 60 extends forwardly above and along the support rack 34, around the forward end portion of the track 16, and returns to the upper or rearward end portion underneath the support rack 34. The opposite end of the roller chain 60 is attached to a bolt 64 that is threaded received in the throughbore 58 of the rearward end portion 50 of the carrier 46. A motor 66 (FIG. 1) is mounted on the upper or rearward end portion of the tunnelling apparatus 10 and includes a drive sprocket 68 (FIG. 2) which engages and moves the roller chain 60 to thereby result in movement of the carrier 46 longitudinally along the track 16 of the underground tunnelling apparatus 10 between the opposite end portions thereof.

As described more fully in the above-referenced copending patent application, the rotational head 14 is used in the assembly and disassembly of a drill string used in an underground tunnelling operation and to advance the drill string with a boring head mounted on its proximal end portion during the underground tunnelling operation. The threaded stem section 18 is rotatable in both directions by the rotational head 14 as controlled by an operator from the operator's station 24. In the operation of the underground tunnelling apparatus 10, the rotational head 14 is used to thread the stem portion 18 onto the distal end portion of a pipe section such as is illustrated at 70 in FIG. 1. After the rotational head 14 has threaded the stem section 18 onto the pipe section 70, further counterclockwise rotation of the rotational head 14 will result in counterclockwise rotation of the drill string 70. During the threading of the stem section 18 onto the distal end portion of the pipe section 70, the rotational head 14 will be drawn closer to the pipe section 70. If, as is common, the pipe section 70 is being held against rotation by one or both of the clamps 20 and 22, some accommodation of movement of the rotational head 14 must be made.

In prior art devices, the rotational head 14 was connected directly to the roller chain 60. Accordingly, during threading or unthreading of the rotational head and a pipe section, the operator was required to adjust by manipulation of the controls at the operator's station 24 the position of the rotational head 14. To maintain the appropriate relative position of the rotational head 14 and the pipe section 70 required frequent and small incremental movements of the controls. Accordingly, whereas the threading or unthreading action of the rotational head and pipe section dictates a smooth, continuous adjustment in relative position, manual manipulation of the controls produces a jerking relative motion wherein the rotational head moves abruptly from being relatively too close to the pipe section to being relatively too far, or vice versa.

In the present invention, the roller chain 60 is attached to the carrier 46 rather than directly to the rotational head 14. Because the rotational head 14 is free to move within a range defined by contact of the base plate 38 with opposing engagement surfaces of the carrier 46, the lost motion connection therebetween permits free or independent movement of the rotational head 14 during a threading or unthreading operation. The invention also performs the required function of translational movement of the head 14 in either direction along the track 16 upon movement of the carriage 46 in the corresponding direction after engagement of the carrier 46 with the corresponding end portion of the rotational head 14. Thus, powered translational movement of the rotational head 14 along the track 16 is accomplished. Further, the threading and unthreading operational efficiency of the underground tunnelling apparatus is enhanced while reducing the demands on the operator.

Although the invention has been described with respect to a preferred embodiment thereof, it is to be also understood that it is not to be so limited since changes and modifications can be made therein which are within the full intended scope of this invention as defined by the appended claims.

I claim:

1. Apparatus for mounting a rotational drive unit comprising:

(a) guide rail means on a support rack having transversely spaced longitudinal guide surfaces;

(b) a slide platform supporting said rotational drive unit and having transversely spaced longitudinal slide surfaces which engage said guide surfaces to mount said slide platform on said support rack for relative longitudinal reciprocal movement thereon;

(c) a pair of longitudinally spaced, opposing engagement surfaces on said slide platform;

(d) a carrier positioned on said support rack, said carrier having a longitudinal central member and a pair of opposing cross members at opposite end portions of said central member;

(e) means for reciprocally moving said carrier longitudinally along said support rack; and (f) wherein said carrier cross members are outside of said engagement surfaces of said slide platform whereby said slide platform has a range of independent longitudinal motion relative to said carrier defined at one limit by contact of a first of said pair of engagement surfaces of said slide platform with a corresponding one of said cross members of said carrier and at an opposite limit by contact of the second of said pair of engagement surfaces with the other of said cross members.

2. Apparatus as defined in claim 1, wherein said carrier cross members extend transversely to opposite sides of said central member.

3. Apparatus as defined in claim 2, wherein said carrier is substantially I-shaped.

4. Apparatus as defined in claim 1, further comprising slot means in said slide platform, and wherein said central member of said carrier is received in said slot means for longitudinal sliding movement relative to said slide platform.

5. Apparatus as defined in claim 4, wherein said slot means is formed in said slide platform to position said carrier substantially centered between said slide surfaces.

* * * * *